US005839288A

United States Patent [19]

Dotson

[11] Patent Number: 5,839,288

[45] Date of Patent: Nov. 24, 1998

[54] AIR CONDITIONING AND DEHUMIDIFYING SYSTEM

[75] Inventor: Danny L Dotson, Adkins, Tex.

[73] Assignee: Munters Corporation, Ft. Myers, Fla.

[21] Appl. No.: 878,127

[22] Filed: Jun. 18, 1997

[51] Int. Cl.[6] ..... F25D 17/06

[52] U.S. Cl. ..... 62/94; 62/271; 62/404; 62/413

[58] Field of Search ..... 62/89, 90, 93, 62/94, 271, 404, 405, 407, 408, 413; 165/222, 211

[56] References Cited

U.S. PATENT DOCUMENTS 5,373,704 12/1994 McFadden ..... 62/94

5,426,953 6/1995 Meckler ..... 62/271

*Primary Examiner*—John M. Sollecito

*Attorney, Agent, or Firm*—Fitzpatrick, Cella, Harper & Scinto

[57] ABSTRACT

A method and apparatus for conditioning air is disclosed which includes a housing and a first fan for drawing return air from an enclosure and returning at least some of the return air to the enclosure at a first location. The housing includes a make up air opening which allows make up air from the atmosphere to enter the housing for mixture within the housing with the return air for discharge by the first fan to the enclosure. The housing also includes air drying apparatus and a second fan for selectively drawing some of the make up air and the return air from the housing through the air drying apparatus and supplying the thus dried air to the enclosure at a position remote from the first location.

23 Claims, 2 Drawing Sheets

| SUMMER | | A | B | C | D | E | F | G | H | I | J | O |
|---|---|---|---|---|---|---|---|---|---|---|---|---|
| | SCFM | 3000 | 27000 | 10000 | 10000 | 5000 | 15000 | 5000 | 20000 | 20000 | 20000 | 10000 |
| | DEGREES F | 98 | 75 | 82 | 111 | 75 | 99 | 99 | 81 | 52 | 55 | 101 |
| | GR/LB | 113 | 52 | 70 | 28 | 52 | 36 | 36 | 48 | 48 | 48 | 36 |

AIR CONDITIONING AND DEHUMIDIFYING SYSTEM

CROSS REFERENCE TO RELATED APPLICATIONS (Not Applicable)

STATEMENT REGARDING FEDERAL SPONSORED RESEARCH OR DEVELOPMENT (Not Applicable)

BACKGROUND OF THE INVENTION

The present invention relates generally to air conditioning systems, and more in particular to an air conditioning system which draws air from an enclosure, produces two separate air supplies of different temperature and/or humidity conditions from that air stream and supplies the two air streams to two discrete locations within the enclosure.

Air conditioning systems for cooling air in an enclosed space typically must condense water vapor from an air stream to achieve adequate dehumidification. The result is that the air conditioning system must perform two functions; it works to maintain temperature control in the space (sensible load) and also must remove the heat of condensation from the water vapor which is extracted from the air stream to maintain the desired level of humidity in the enclosed space (latent load). This requires that the air conditioning system have increased capacity to handle both tasks.

Typically, it has been found that in large enclosures such as, for example, supermarkets, different sectors of the enclosure require air streams of different temperature and humidity conditions. For example, it is typically desirable to have dryer air present in the portion of the enclosure at which open freezer cases are displayed in order to reduce condensation of moisture from the air on the shelves and other exposed surfaces of the freezer cases, while it is preferable to have more humid air in the remainder of the store. Because of these two conflicting air condition requirements, prior air conditioning systems had to be operated at compromised conditions or two separate conditioning systems were required.

Where an air conditioning system using a single air supply is employed, air is typically withdrawn from one or more specific locations within the enclosure (say near the floor and ceiling) drawn into the air conditioning unit where the entire return air (or to a portion of the return air with some make up air from the atmosphere) is dehumidified, cooled (or heated) and then returned to the enclosure at the ceiling. Such units condition the entire space and attempt to maintain constant temperature and humidity levels throughout the space. In that case, the air was either too dry for the majority of the enclosure space or too moist for the portion of the environs of the enclosure surrounding the open freezer cases. One illustrative example of this prior art system using a desiccant wheel dryer for both return air and make up air is disclosed in U.S. Pat. No. 2,200,243. Another system in which only return air appears to be dehumidified is disclosed in U.S. Pat. No. 5,373,704.

Another previously proposed air conditioning system directed to this problem uses two separate systems on the roof of the building to accommodate the different needs of different locations within the building or enclosure. Thus, for example, a single air conditioning/heating/dehumidification system was used for the majority of air in the enclosure, drawing air from near the ceiling, conditioning and drying it if necessary, and returning to the enclosure through ceiling vents. A second, perhaps smaller, air conditioning and dehumidification system was also provided for withdrawing some return air from the enclosure, conditioning it to the desired lower humidity conditions and returning it to the area of the enclosure surrounding the freezer cases, sometimes beneath the freezer cases. While such targeted air conditioning systems have been generally satisfactory in providing different air conditions at different locations within an enclosure, the requirements for two or perhaps more separate air conditioning units greatly increased capital expenses and costs of operations.

Accordingly, it is an object of the present invention to provide a method and apparatus for conditioning air which can withdraw return air from an enclosure, create two streams of air of different temperature and/or humidity conditions and return the two streams of air to two separate locations within the enclosure.

Another object of the invention is to provide an air conditioning method and apparatus of the character described which can produce two differently conditioned air supply streams to be supplied to different locations within an enclosure.

Yet another object of the present invention is to provide an air conditioning system which is reliable in use and economical to manufacture and operate.

In accordance with an aspect of the present invention, an apparatus is provided for conditioning air in an enclosure having at least one location to which it is desirable to supply treated and/or cool air and a second location, remote from the first location, to which it is desirable to supply air which is dryer than that supplied to the first location. The apparatus includes a housing having an air mixing chamber and first and second air inlet ports. The first air inlet port is adapted to receive return air from the enclosure and the second inlet port is adapted to receive make up air from the atmosphere. A first, primary fan draws return air (from near the ceiling or floor, or both, of the enclosure) and make up air into the mixing chamber through the inlets causing the air to mix. The fan supplies at least a part of the air from the mixing chamber and from a dehumidifier described below to the enclosure. Air cooling and/or heating means are provided to selectively heat or cool the air being returned by the first fan to the enclosure. Preferably this air is supplied to the majority of the volume of the enclosure, for example, through ceiling vents.

The housing of the apparatus also contains an air drying desiccant apparatus such as a desiccant wheel. A second fan is provided for drawing a part of the return air and all or part of the make up air from the mixing chamber, passing it through the desiccant apparatus for drying and supplying the thus dried air to an enclosure at a second location. That second location may be in the area of freezer cases in the enclosure, and particularly through ducts located beneath the freezer cases. This is the area where deeply dried air is of the most value.

The advantage of the system of the present invention is its ability to maintain a low dewpoint in one zone and provide conditioned air to the remaining space simultaneously from a single unit. Thus, a single piece of equipment will condition the entire space and target a specific zone where lower levels of humidity are needed. This is accomplished with the aid of a secondary supply fan to deliver air at a different condition than the primary supply fan.

The above, and other objects, features an advantage of this invention will be apparent in the following detailed description of an illustrious embodiment thereof, which is to be read in connection with the accompanying drawings, wherein.

DETAILED DESCRIPTION

Figures 1, 4:
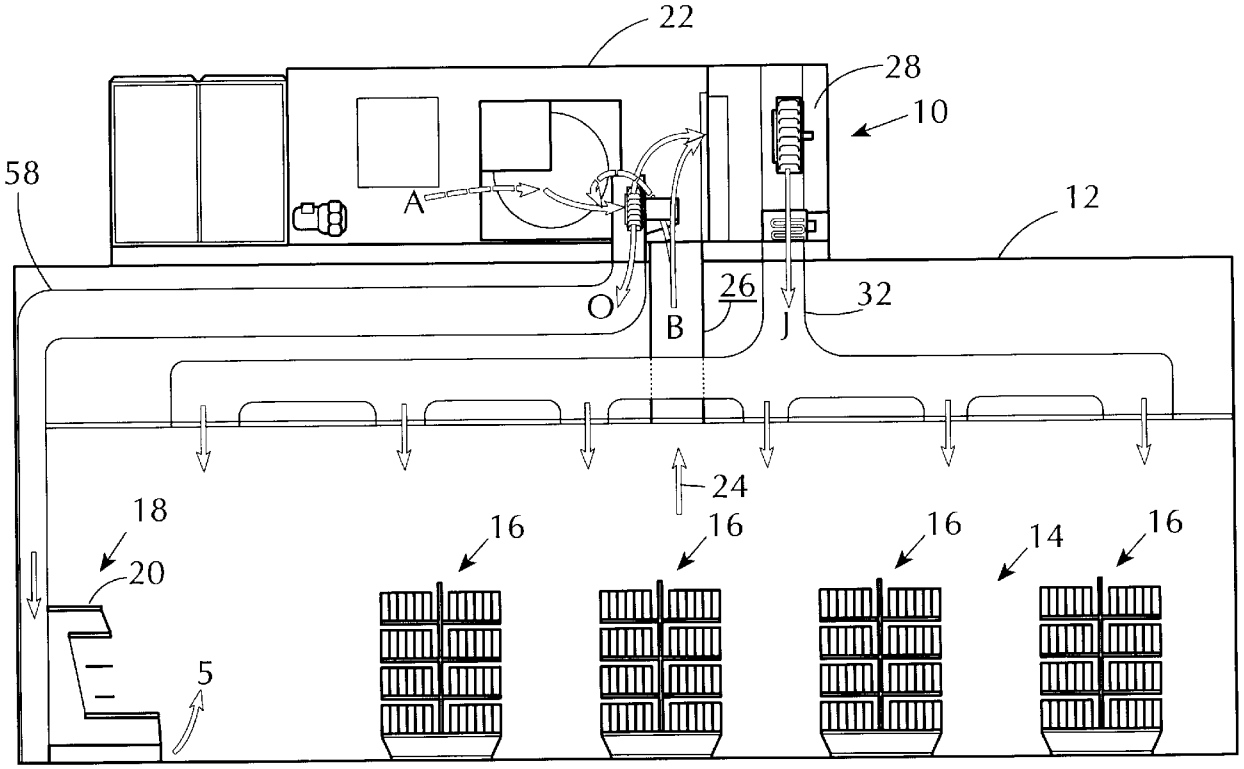
FIG. 1 is a schematic elevational view of an air conditioning system constructed in accordance with the present invention; with the air flow paths illustrated by arrows.
FIG. 4 is a chart reflecting the conditions of air in the various air streams as it flows through the apparatus to the enclosure.

Referring now to the drawing in detail, and initially and FIG. 1, an air conditioning apparatus 10 constructed in accordance with the present invention is illustrated. Apparatus 10 is adapted to draw air from an enclosure 12, such as for example a supermarket, condition the air and return it to the enclosure or building. As illustrated in FIG. 1, the supermarket enclosure includes a plurality of aisles 14 containing display shelves 16 for conventional dry goods throughout the majority of the volume of the store. In this area of the store, it is typically desirable to maintain comfortable temperature and humidity conditions for human comfort such as would be present in a normal room environment in a home. The building also includes an area 18 containing refrigerated display or freezer cases 20, wherein the surrounding air is cooler than the majority of the building as a result of humid atmosphere maintained by these display cases. As a result, moisture in the air tends to condense in the display cases causing ice build up. Therefore, it is desirable at this area of the building to provide dryer air than through the remainder of the building. The air conditioning unit 10 of the present invention accomplishes these two diverse desirable goals.

Figure 2:
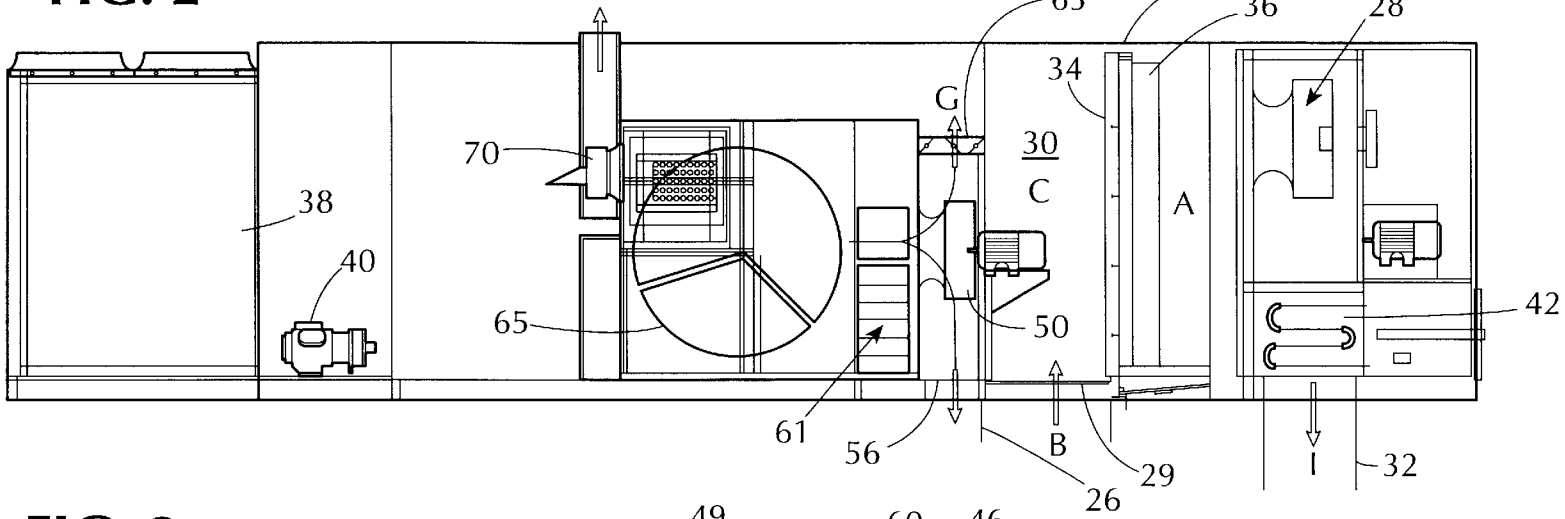
FIG. 2 is an enlarged side view illustrating the apparatus of the present invention.

Air conditioning system 10 includes a housing 22 which is typically located on the roof of the building 12. A return air stream 24 is drawn from enclosure 12 through a duct work 26 by a first or primary fan 28 located within enclosure 22. Duct work 26 typically includes a plurality of return air vents in the ceiling or near the floor of the building to direct return air to a main plenum and the air inlet opening 29 in the base of the housing 22 (see FIG. 2) where the air enters a mixing chamber 30.

Fan 28 may be of any known construction. As illustrated, fan 28 is a turbine type fan which draws air through the return duct 26 and mixing chamber 30 to its center and discharges the air tangently from its housing to the air return duct system 32 which, is seen in FIG. 1, distributes the air to a plurality of air outlets in the ceiling of the building.

Contained within housing 22 in a conventional manner are a filter system 34 for filtering the return air, along with a cooling coil arrangement 36 for cooling the return air before it enters fan 28. The cooling coils are of conventional construction and communicate with a conventional condenser arrangement 38, forming no part of this invention, under the influence of conventional pumps 40. In the winter time it may be desirable not to cool the return air but to heat it instead. For this purpose, selectively operable gas heaters 42 or the like are provided within enclosure 22 for selectively heating the air from fan 28 before it is returned to the enclosure. As with the cooling coils, the precise mechanism for heating the air does not form part of this invention and its operation and construction will be understood by those skilled in the art.

In accordance with a feature of the present invention, enclosure 22 includes a make up air inlet 46 which permits atmospheric air to enter mixing chamber 30 under the influence of fan 28. The volume of the make up air permitted to enter the chamber 30 is controlled by dampers 48, with the amount of make up air used varying with the particular temperature and humidity conditions desired within the enclosure 12.

Figure 3:
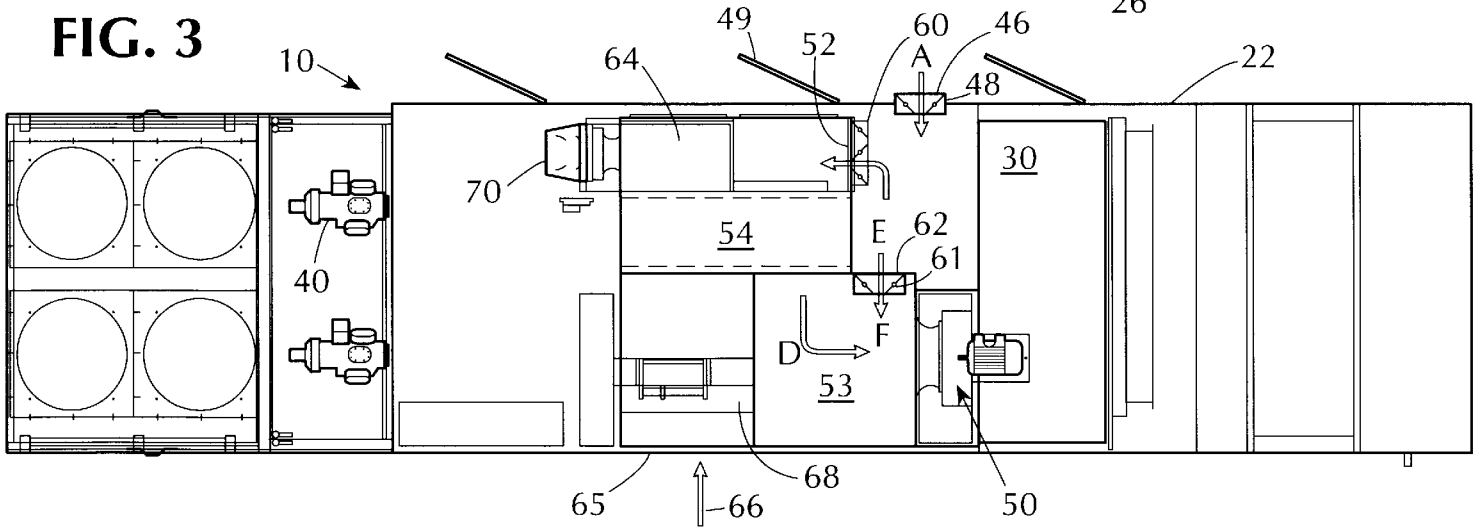
FIG. 3 is a top plan view of the apparatus of the present invention.

In accordance with another feature of the present invention, a second fan 50 is provided in housing 22. This fan serves to draw make up air through damper 49 and to selectively draw return air and make up air from chamber 30 into a plenum 52 through damper 60. From there the air is drawn through a desiccant wheel 54. The mixed air passing through the desiccant wheel, as indicated by the arrows in FIG. 3, is drawn through the centrifugal fan 50 and discharged through an outlet opening in the base of the housing to the air return duct 58. That duct, as shown in FIG. 1, supplies the dried air to the area 18 of the enclosure and, preferably, to a position beneath the refrigerated cases so that the dried air is discharged immediately in their vicinity. Damper arrangement 60 is provided at the inlet to plenum 52 to selectively allow some mixed make up and return air from plenum 30 to mix with additional return air entering plenum 52 through samper 49. Another damper 61 is located at the corner 62 of the plenum 53. These dampers are selectively operable, as would be understood by those skilled in the art, to prevent air from entering the desiccant wheel and bypass the desiccant wheel if temperature and humidity within the enclosure warrant that. In addition, a third set of dampers 63 are provided on the enclosure of fan 50 to selectively discharge some of the dehumidified air from the desiccant wheel to the chamber 30 for discharge to the enclosure 12 by fan 28.

The desiccant wheel used in the apparatus of the present invention is of a conventional construction and is of the type provided by the Munters Corporation. The desiccant wheel is a rotating body having a plurality of through passages formed therein which are coated with a conventional known desiccant material. The air from chamber 30, which is relatively humid air, passes through the wheel and moisture is removed by the desiccant material. As the wheel rotates, it passes through a duct segment 64 through which a stream atmospheric air 66, which is heated by gas heaters 68 or the like before entering the desiccant wheel. The heated air removes the moisture from the desiccant wheel and is drawn through the desiccant wheel by a third fan 70 and discharged to the atmosphere.

By this construction, two separately conditioned air streams are supplied to different locations of the enclosure, with one air conditioning apparatus. The system avoids the need for two separate air conditioning apparatus while allowing careful control of temperature and humidity conditions at two different locations within the enclosure.

FIG. 4 is a chart showing an exemplary operated condition for an apparatus constructed in accordance with the present invention. The letters along the top of the chart correspond to the lettered points in the air streams identified in FIGS. 3 and 4. The numbers beneath each letter represent square cubic feet per minute as a volume of air flow; the temperature of the air; and the humidity of the air in grams per pound. Thus, for example, at point A in this example, make up air is drawn into the housing at the rate of 3,000 cubic feet per minute at a temperature of 98° F. and a humidity of 113 grams per pound. When discharged to the refrigerated cases the dehumidified make up air and return air at point 0 is supplied to the refrigerated cases at 101° F. but a humidity of 36 grams per pound.

The operating principles of the invention are simple. Return air is drawn into the unit and blended with the make up air through the desiccant face damper 60 or, alternatively, is blended with just some of the make up air. This air is dried as it is drawn through the desiccant wheel 54 by the process fan 50. Moisture is removed from the desiccant wheel when outside air is drawn into the reactivation inlet 65 by the reactivation fan 70. The reactivation air is heated by the reactivation heater 68 which lowers the RH of the air thus extracting the moisture collected by the desiccant wheel.

Additional return air is drawn in by the process fan 50 through the desiccant by-pass damper 62 when air tempering or additional volume is required. All or a majority of the blend of warm dry air is then supplied to the zone where the low dewpoint is of the most benefit. The remaining blend of warm, dry air is supplied to the return plenum through the process balancing damper 63 where it is blended with the remaining return and outside air. This blended air is drawn through the optional cooling coil 36 by the supply fan 20 and discharged through the optional auxiliary heaters 32 to the remaining space.

Although an illustrative embodiment of the present invention has been described herein, it is to be understood that the invention is not limited to that precise embodiment, and that various changes in modification may be effective therein of those skilled in the art without the departing the scope or spirit of this invention.

It is claimed:

1. Apparatus for conditioning air including a housing, first fan means for drawing return air from an enclosure and returning at least some of said return air to the enclosure at a first location; said housing including a make up air opening for allowing make up air from the atmosphere to enter said housing and be mixed with said return air under the influence of said first fan means for discharge to the enclosure; means in said housing for drying air; second fan means for selectively drawing some of said make up air and/or return air from said housing through said air drying means and supplying the dried mixture of make up air and return air to the enclosure at a position remote from said first location.

2. Apparatus as defined in claim 1 wherein said housing has an air mixing chamber into which said make up air and return air are drawn and mixed under the influence of said first and/or second fan.

3. Apparatus as defined in claim 1 including means located between said mixing chamber and said first fan means for selectively cooling the mixture of return air and make up air returned to said first location by the first fan means.

4. Apparatus as defined in claim 3 including duct means for discharging the mixture of make up air and return air from the first fan means to said first location.

5. Apparatus as defined in claim 4 wherein said first location is adjacent the ceiling of the enclosure.

6. Apparatus as defined in claim 1 wherein said air drying means includes a body having a plurality of air passages formed therein including a desiccant material.

7. Apparatus as defined in claim 6 wherein said body is a rotatable desiccant wheel.

8. Apparatus as defined in claim 7 including duct means for supplying the dried mixture of make up air and return air from said second fan means to said second location, wherein said second location is remote from the first location.

9. Apparatus as defined in claim 8 wherein said second location is adjacent freezer cases in the enclosure.

10. Apparatus as defined in claim 9 including selectively operable damper means in the housing for by-passing said desiccant wheel.

11. Apparatus as defined in claim 5 wherein said air drying means includes a body having a plurality of air passages formed therein including a desiccant material.

12. Apparatus as defined in claim 11 wherein said body is a rotatable desiccant wheel.

13. Apparatus as defined in claim 12 including duct means for supplying the dried mixture of make up air and return air from said second fan means to said second location, wherein said second location is remote from the first location.

14. Apparatus as defined in claim 13 wherein said second location is adjacent freezer cases in the enclosure.

15. Apparatus as defined in claim 14 including selectively operable damper means in the housing for by-passing said desiccant wheel.

16. Apparatus as defined in claim 15 wherein said air drying means includes a body having a plurality of air passages formed therein including a desiccant material.

17. Apparatus for conditioning air in an enclosure having at least one location to which it is desirable to supply heated and/or cooled air and a second location remote from said first location to which it is desirable to supply air which is drier than that supplied to the first location; said apparatus including a housing, an air mixing chamber in said housing, a first air inlet port for receiving make up air from the atmosphere in said chamber; first fan means for drawing return air and make up air into said chamber wherein said air is mixed and for supplying at least a part of the mixed return air and make up air to the enclosure at said first location; and an air drying desiccant wheel in said enclosure, second fan means for drawing a portion of the make up air and the return air from the mixing chamber, passing it through the desiccant wheel for drying and supplying the thus dried air to the enclosure at said second location.

18. Apparatus as defined in claim 17 including means located between said mixing chamber and said first fan means for selectively cooling the mixture of return air and make up air returned to said first location by the first fan means.

19. Apparatus as defined in claim 18 including duct means for discharging the mixture of make up air and return air from the first fan means to said first location, wherein said first location is adjacent the ceiling of the enclosure.

20. Apparatus as defined in claim 19 including duct means for supplying the dried mixture of make up air and return air from said second fan means to said second location wherein said second location is beneath freezer cases in the enclosure.

21. Apparatus as defined in claim 20 including selectively operable damper means in the housing for by-passing said desiccant wheel.

22. A method of conditioning air for an enclosure having at least one location to which it is desirable to supply heated and/or cooled air and a second location remote from said first location to which it is desirable to supply air which is dryer than that supplied to said first location; said method including the steps of drawing return air from said enclosure into a mixing chamber, drawing make up air from the enclosure into said mixing chamber to be mixed with the return air; heating and/or cooling at least a first portion of the air mixture in from the mixing chamber and supplying it to said first location; drawing a second portion of the air from the mixing chamber, drying said second portion in a desiccant wheel and supplying the dried air to said second location.

23. The method as defined in claim 21 wherein said second portion of air from said mixing chamber is smaller than said first portion.

* * * * *